US008371604B1

(12) United States Patent
Soucy

(10) Patent No.: US 8,371,604 B1
(45) Date of Patent: Feb. 12, 2013

(54) BI-DIRECTIONAL SNOWBOARD WITH PARALLEL REVERSE CAMBERS FOR REDUCED SNOW CONTACT AND WITH TRACTION PLANES FOR INCREASED EDGE CONTROL

(76) Inventor: Shawn Soucy, Blackhawk, CO (US)

( * ) Notice: Subject to any disclaimer, the term of this patent is extended or adjusted under 35 U.S.C. 154(b) by 210 days.

(21) Appl. No.: 12/927,029

(22) Filed: Nov. 5, 2010

(51) Int. Cl.
*A63C 5/04* (2006.01)

(52) U.S. Cl. ..... 280/609; 280/14.22; 280/602

(58) Field of Classification Search ..... 280/600, 280/602, 607, 608, 609, 14.21, 14.22
See application file for complete search history.

(56) References Cited

U.S. PATENT DOCUMENTS 5,823,562 A * 10/1998 Stubblefield ..... 280/609
6,352,268 B1 * 3/2002 Peart ..... 280/14.21
6,382,658 B1 * 5/2002 Stubblefield ..... 280/609
7,798,514 B2 * 9/2010 Canaday et al. ..... 280/609
8,029,013 B2 * 10/2011 Canaday et al. ..... 280/609

* cited by examiner

*Primary Examiner* — John Walters

(74) *Attorney, Agent, or Firm* — Edwin H. Crabtree; Ramon L. Pizarro

(57) ABSTRACT

An improved bi-directional snowboard having a board member with a pair of parallel, downwardly extending, reverse cambers or rockers disposed between a pair of snow boot bindings mounted on a top surface of the board member. The reverse cambers provide for reduced snow contact upon engaging the snow surface and increased speed during downhill racing. Also, the board member includes a pair of convex-shaped, traction planes on opposite sides of the board member between the board bindings. The traction planes provide for increased edge control and stability when making hard turns and during difficult snow conditions.

18 Claims, 2 Drawing Sheets

BI-DIRECTIONAL SNOWBOARD WITH PARALLEL REVERSE CAMBERS FOR REDUCED SNOW CONTACT AND WITH TRACTION PLANES FOR INCREASED EDGE CONTROL

BACKGROUND OF THE INVENTION (a) Field of the Invention

This invention relates to an improved bi-directional snowboard, and more particularly, but not by way of limitation, to a snowboard having parallel reverse cambers or rockers disposed between the board bindings for reduced snow contact and convex-shaped, traction planes on opposite sides of the board between the board bindings for increased edge control when making hard turns.

(b) Discussion of Prior Art

Heretofore, traditional bi-directional snowboards don't particularly grip well throughout a hard turn. Also, the boards tend to slip during a board landing after a large amplitude spin trick, such as in 900 degrees or more rotation.

Today, some prior art snowboards incorporate a wavy edge profile along opposite sides of the board and with a single reverse camber, along the length of the board. Also, another board design, as described in published U.S. Patent Application 2009/0256333 to Canaday, includes a reverse camber in combination with a standard board camber. But, the reverse camber is disposed outside of the area between the board bindings.

None of the current snowboard designs include the unique features, structure, function aid advantages of the subject bi-directional snowboard as disclosed herein.

SUMMARY OF THE INVENTION

In view of the foregoing, it is a primary objective of the subject invention to provide a greatly improved snowboard for decreased snow contact and increased downhill speed during snowboard competition.

Another object of the invention is the board includes increased edge contact area along the opposite sides of the board and between the board bindings for improved stability during hard turns and difficult snow conditions.

These and other objects of the present invention will become apparent to those familiar with the use of camber, reverse camber and edge control areas in a bi-directional snowboard when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised for the practical application of the snowboard, and in which.

DETAILED DESCRIPTION OF THE PREFERRED EMBODIMENTS

Figure 1:
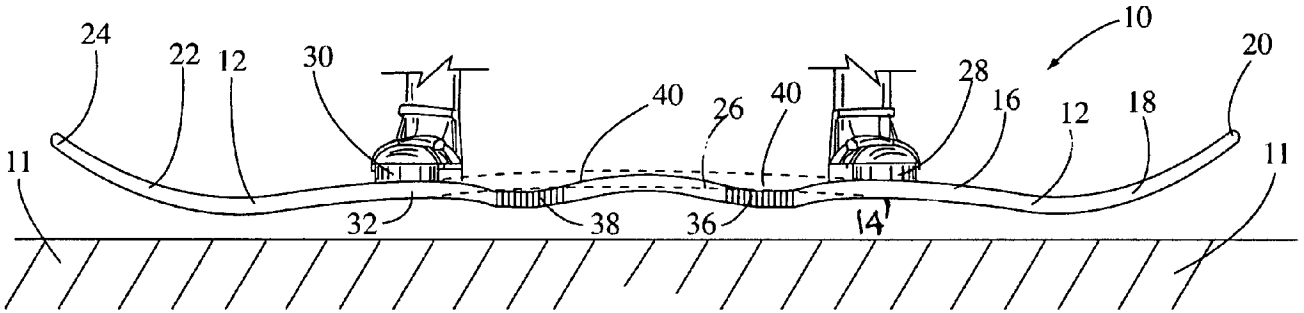
FIG. 1 illustrates a front view of the subject bi-directional snowboard shown in flight and prior to landing on a snow surface. A pair of parallel reverse cambers or rockers are shown between a pair of snow boot bindings.
Figure 3:
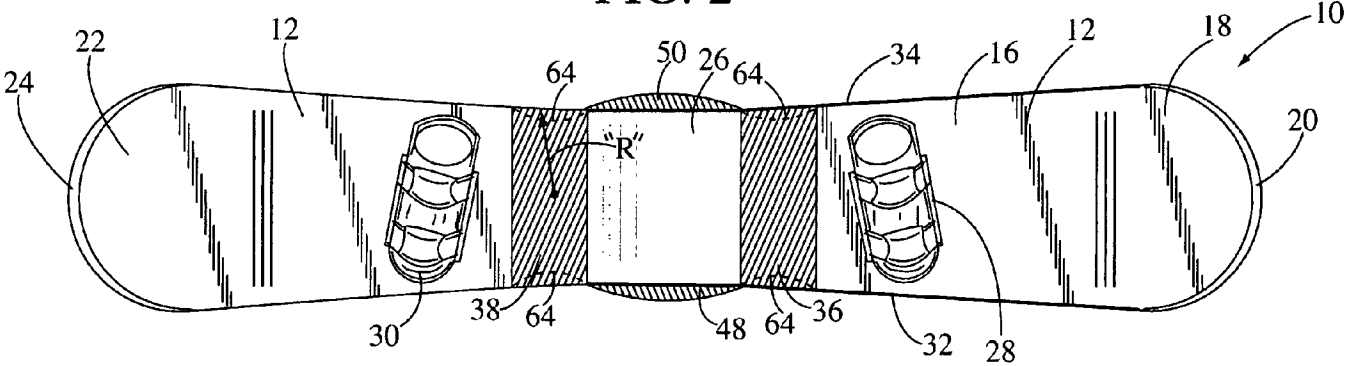
FIG. 3 is a top view of the snowboard and illustrates a typical hour glass profile of a bi-directional board. In this view, a convex-shaped, traction plane is shown extending outwardly from opposite sides of the board and between the parallel reverse cambers.

In FIG. 1, a front view of the subject bi-directional snowboard, having general reference numeral 10, is shown in flight and prior to landing on a snow surface 11. The snowboard 10 has an hour glass profile, as shown in FIG. 3

The snowboard 10 includes a board member 12 having a snow engaging bottom surface 14 and a top surface 16. The board member further includes a first end 18 flared upwardly to a rounded first tip 20, a second end 22 flared upwardly to an identical, rounded second tip 24, a middle portion 26 for mounting a pair of spaced apart, snow boot bindings 28 and 30, a first side 32 and a second side 34. The second side 34 is shown in FIG. 3.

Today's bi-directional snowboards incorporate an upwardly extending camber between the opposite ends of the board. The camber provides for a quick release from the snow surface during turns, jumps and tricks. When the board lands, the weight of the rider compresses the bottom of the board against the snow surface and the majority of the cambered surface of the board engages the snow surface. The subject board 10 addresses this feature and reduces the snow contact surface between the snow boot bindings 28 and 30 using a pair of spaced apart, parallel reverse cambers 36 and 38. The reverse cambers 36 and 38 are shown using closely spaced vertical lines. In this drawing, a mid-portion of a standard board's, upwardly extending, bow-shaped, camber is shown in dashed lines 40. On both sides of the mid-portion of the standard camber 40 are the downwardly extending reverse cambers 36 and 38 and disposed between the two bindings 28 and 30. This key feature of the reverse cambers 36 and 38 eliminates a portion of the bow-shaped camber 40, as seen in this drawing.

Figure 2:
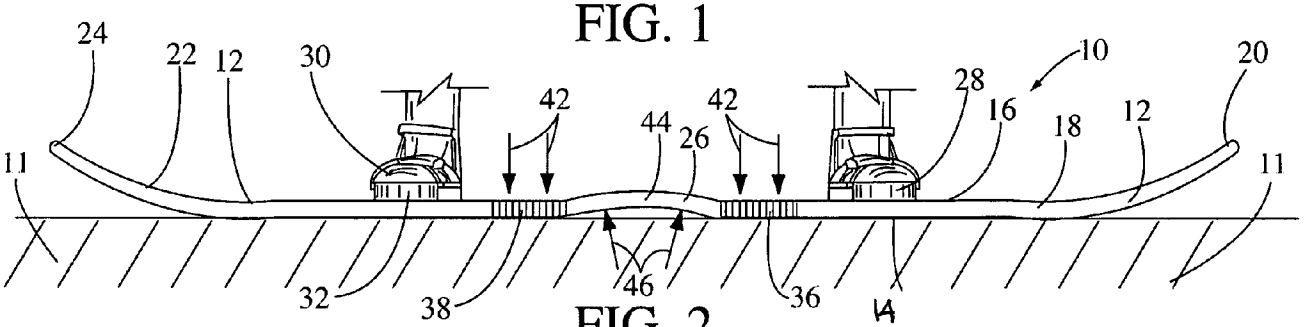
FIG. 2 illustrates another front view of the snowboard and having landed on the snow surface. In this drawing, arrows indicate the reverse cambers engaging the snow, while a balance of the board's camber is disposed above the snow.

In FIG. 2, another front view of the snowboard 10 is shown and having landing on the snow surface 11. In this drawing, arrows 42 indicate the reverse cambers 36 and 38 engaging the snow, while a balance of a center portion 44 of the board's camber 40 is still disposed above the snow surface 11, as indicated by arrows 46. In this manner, when the board rider places his or her weight on the snowboard 10, the reverse cambers 36 and 38 26 engage the snow surface 11 between the bindings 28 and 30 to reduce the contact area of the bottom surface 14 of the board member 12 and provide added speed during snowboard racing.

In FIG. 3, a top view of the snowboard 10 is shown and illustrates the typical hour glass profile of the bi-directional board. In this view, a pair of convex-shaped, traction planes 48 and 50 are shown in vertical diagonal lines. The traction planes 48 and 50 extend outwardly from the first and second sides 32 and 34 of the board member 12 and between the parallel reverse cambers 36 and 38. Through trail and error, the use of the traction planes 48 and 50 in combination with the reverse cambers 36 and 38, edge control and board stability are greatly improved during hard turns of the board and other difficult snow conditions. Also shown in this drawing are diagonal lines depicting the area of the reverse cambers 36 and 38 across a width of the board member 12. Also shown in this drawing is a radius "R" extending from a center of the reverse cambers 36 and 38 and extending to an edge of the width of the two cambers.

Figure 4:
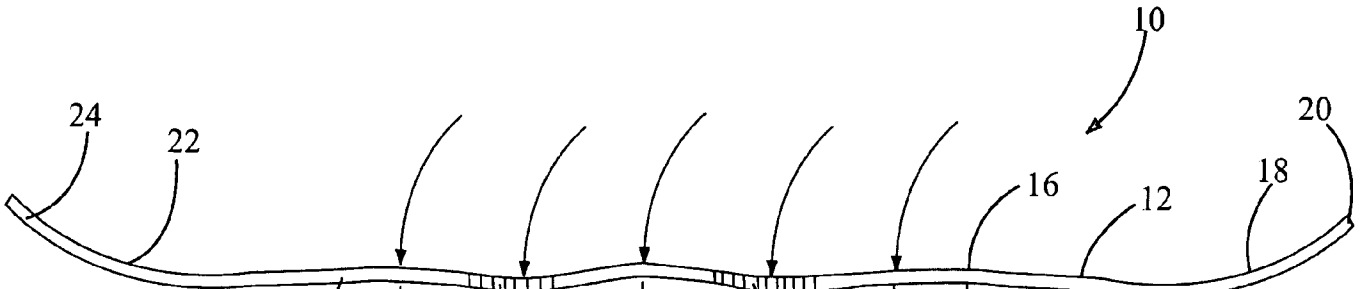
FIG. 4 is another side view of the snowboard with dashed, vertical lines for illustrating the center of the snowboard, the mounting area for the bindings, and the depth of the reverse cambers.
Figure 5:
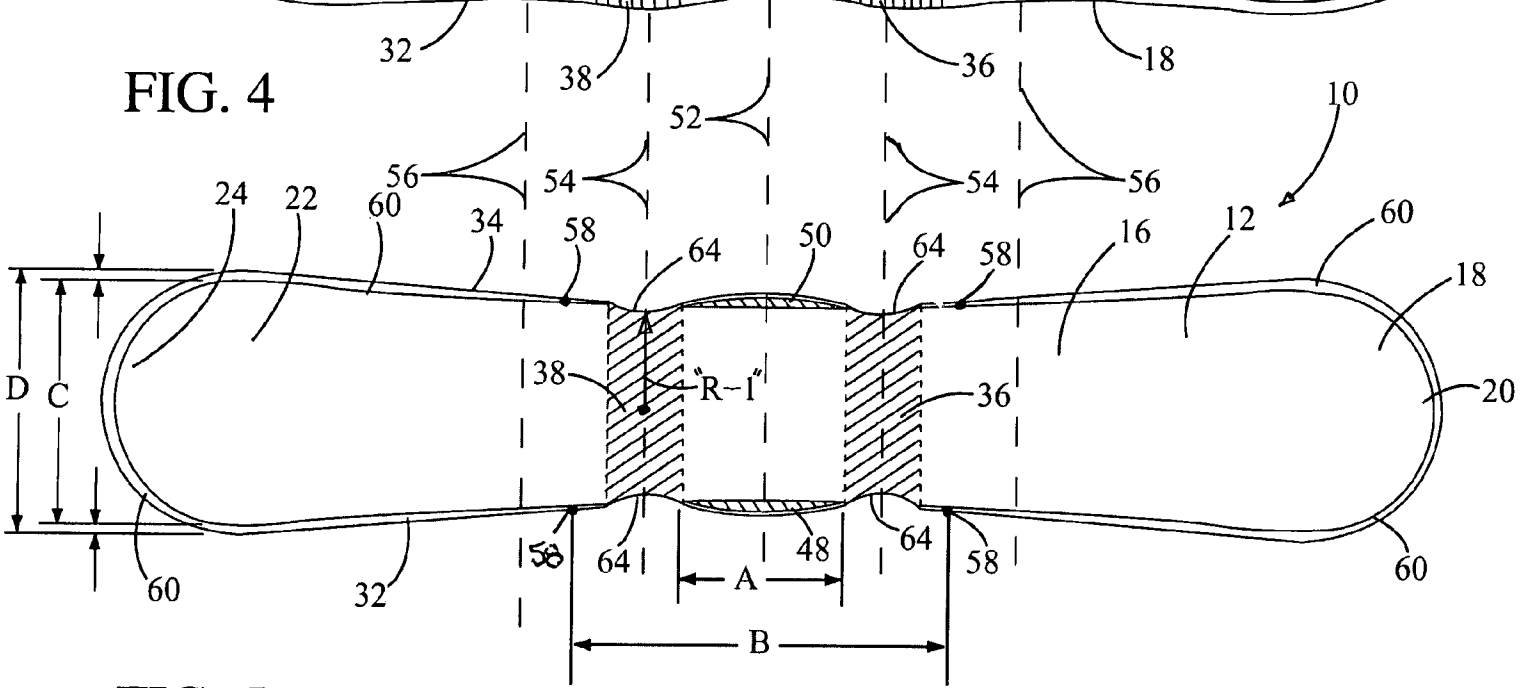
FIG. 5 is another top view of the snowboard illustrating increased snow contact edges in the opposite sides of the board for greatly improved stability.

In FIGS. 4 and 5, another side view and top view of the snowboard 10 is illustrated. In these drawings, a dashed vertical line 52 is shown illustrating the center of the snowboard. Also, a pair of dashed lines 54 are shown illustrating a center line through the reverse cambers 36 and 38. Typically, a depth of the reverse cambers are in a range of 0.5 to 6 mm and preferably 3 mm in depth. Further, a pair of dashed lines 56 are shown illustrating a center line through an area for mounting the binding 28 and 30 thereon.

In FIG. 5, a typical length "A" of the traction planes 48 and 50 is 22 cm along a portion of the sides 32 and 34. Also, a distance "B" between a pair of starting points 58 in the first and second sides 32 and 34 is 52 cm. At the starting points 58, an increased flare 60 or kink starts an additional width and added contour to the first and second ends 18 and 22. Typical width "C" of the ends 18 and 22 is 29 cm. With the increase flare 60, a width "D" is 33 cm. Therefore, with an increase of 4 cm in the sides 32 and 34 and curved tips 20 and 24 of the board member 12, the snowboard 10 is provided with increase stability and edge control.

Also shown in this drawing are concave-shaped, side cutouts 64 in opposite sides of the two reverse cambers 36 and 38 and extending inwardly in a range of 0.5 to 6 mm. This added feature of the side cutouts 64 in the reverse cambers provides for an improved, decreased turning radius, shown as "R-1", to achieve a quicker and sharper turning bi-directional snowboard 10.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The invention claimed is:

1. An improved bi-directional snowboard for reduced snow contact when engaging a snow surface, the snowboard adapted for mounting a pair of spaced apart, snowboard bindings thereon, the snowboard comprising;

a board member having a top surface, a bottom surface adapted for engaging the snow surface, a first end with rounded tip, a second end with rounded tip, a middle portion adapted for mounting the pair of spaced apart, snow boot bindings on the top surface, a first side and a second side;

a bow-shaped camber extending upwardly from the first and second ends of the board member; and a pair of parallel, spaced apart, downwardly extending, bow-shaped, reverse cambers disposed in the middle portion of the board member, the reverse cambers disposed across a width of the board member and between the bindings.

2. The snowboard as described in claim 1 wherein the depth of the reverse cambers is in a range of 0.5 to 6 mm.

3. The snowboard as described in claim 1 wherein the depth of the reverse cambers is 3 mm.

4. The snowboard as described in claim 1 further including a pair of convex-shaped traction planes, the traction planes extending outwardly from the first and second sides of the board member.

5. The snowboard as described in claim 4 wherein the traction planes are disposed between the spaced apart reverse cambers.

6. The snowboard as described in claim 4 wherein the traction planes have a length of approximately 22 cm.

7. The snowboard as described in claim 1 wherein opposite sides of the reverse cambers include a concave-shaped, side cutouts, the cutouts providing decreased snow contact by the reverse cambers, when using the snowboard.

8. An improved bi-directional snowboard for reduced snow contact when engaging a snow surface, the snowboard adapted for mounting a pair of spaced apart, snowboard bindings thereon, the snowboard comprising;

a board member having a top surface, a bottom surface adapted for engaging the snow surface, a first end with rounded tip, a second end with rounded tip, a middle portion adapted for mounting the pair of spaced apart, snow boot bindings on the top surface, a first side and a second side;

a bow-shaped camber extending upwardly from the first and second ends of the board member;

a pair of parallel, spaced apart, downwardly extending, bow-shaped, reverse cambers disposed in the middle portion of the board member, the reverse camber disposed across a width of the board member and between the bindings; and a pair of convex-shaped traction planes, the traction planes disposed in the middle portion of the board member and extend outwardly from the first and second sides of the board member.

9. The snowboard as described in claim 8 wherein the traction planes are disposed between the spaced apart reverse cambers.

10. The snowboard as described in claim 8 wherein the traction planes have a length of approximately 22 cm.

11. The snowboard as described in claim 8 wherein opposite sides of the reverse cambers include a concave-shaped, side cutouts, the cutouts providing decreased snow contact by the reverse cambers when using the snowboard the depth of the side cutouts in a range of 0.05 to 6.0 mm.

12. The snowboard as described in claim 11 wherein the traction planes are disposed between the spaced apart reverse cambers.

13. The snowboard as described in claim 12 wherein the traction planes have a length of approximately 22 cm.

14. The snowboard as described in claim 11 wherein opposite sides of the reverse cambers include a concave-shaped, side cutouts, the cutouts providing decreased snow contact by the reverse cambers when using the snowboard, the depth of the side cutouts in a range of 0.05 to 6.0 mm.

15. An improved bi-directional snowboard for reduced snow contact when engaging a snow surface, the snowboard adapted for mounting a pair of spaced apart snowboard bindings thereon, the snowboard comprising;

a board member having a top surface, a bottom surface adapted for engaging the snow surface, a first end with rounded tip, a second end with rounded tip, a middle portion adapted for mounting the pair of spaced apart, snow boot bindings on the top surface, a first side and a second side;

a bow-shaped camber extending upwardly from the first and second ends of the board member; and a pair of convex-shaped traction planes, the traction planes extending outwardly from the first and second sides of the board member.

16. The snowboard as described in claim 15 further including a pair of parallel, spaced apart, downwardly extending, bow-shaped, reverse cambers disposed in the middle portion of the board member, the reverse camber disposed across a width of the board member and between the bindings.

17. The snowboard as described in claim 16 wherein the depth of the reverse cambers is in a range of 0.5 to 6 mm.

18. The snowboard as described in claim 16 wherein the depth of the reverse cambers is 3 mm.

* * * * *